US011640782B2

(12) United States Patent
Xiao et al.

(10) Patent No.: US 11,640,782 B2
(45) Date of Patent: May 2, 2023

(54) GAMMA ADJUSTMENT METHOD AND APPARATUS FOR DISPLAY PANEL

(71) Applicant: BOE TECHNOLOGY GROUP CO., LTD., Beijing (CN)

(72) Inventors: Xiangchun Xiao, Beijing (CN); Huijun Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 41 days.

(21) Appl. No.: 17/609,233

(22) PCT Filed: May 6, 2020

(86) PCT No.: PCT/CN2020/088804
§ 371 (c)(1),
(2) Date: Nov. 5, 2021

(87) PCT Pub. No.: WO2020/228572
PCT Pub. Date: Nov. 19, 2020

(65) Prior Publication Data

US 2022/0208061 A1 Jun. 30, 2022

(30) Foreign Application Priority Data

May 10, 2019 (CN) ..... 201910390584.0

(51) Int. Cl.
*G09G 3/20* (2006.01)

(52) U.S. Cl.
CPC ..... *G09G 3/20* (2013.01); *G09G 2320/0626* (2013.01); *G09G 2320/0673* (2013.01); *G09G 2354/00* (2013.01); *G09G 2360/144* (2013.01)

(58) Field of Classification Search
None
See application file for complete search history.

(56) References Cited

U.S. PATENT DOCUMENTS

2006/0284895 A1* 12/2006 Marcu ..... G09G 3/20 345/690
2013/0194169 A1 8/2013 Nishida
2014/0292792 A1* 10/2014 Chen ..... G09G 5/10 345/589

FOREIGN PATENT DOCUMENTS

CN 103065609 A 4/2013
CN 103140793 A 6/2013
CN 108615511 A 10/2018
CN 108962126 A 12/2018
(Continued)

OTHER PUBLICATIONS

International Search Report & Written Opinion relating to PCT/CN2020/088804 filed May 6, 2020; dated Jul. 24, 2020.

*Primary Examiner* — Ifedayo B Iluyomade
(74) *Attorney, Agent, or Firm* — Dinsmore & Shohl LLP

(57) ABSTRACT

The invention relates to a gamma adjustment method and device for a display panel. The gamma adjustment method comprises the following steps: obtaining the light intensity of ambient light of a display panel; obtaining a value of the intensity of the reflected light from the display panel according to the light intensity of the ambient light and the corresponding relation between the intensity of the reflected light from the display panel and the light intensity of the ambient light; and determining a gamma curve according to the value of the intensity of the reflected light and the maximum brightness of the display panel.

23 Claims, 5 Drawing Sheets

(56) References Cited

FOREIGN PATENT DOCUMENTS

| | | | |
|---|---|---|---|
| CN | 109493801 | A | 3/2019 |
| JP | 2007241059 | A | 9/2007 |

* cited by examiner

GAMMA ADJUSTMENT METHOD AND APPARATUS FOR DISPLAY PANEL

CROSS-REFERENCE TO RELATED APPLICATIONS

This application is a U.S. National Stage under 35 U.S.C. § 371 of International Application No. PCT/CN2020/088804, as filed on, May 6, 2020, which claims a priority of a Chinese patent application No. 201910390584.0 that was filed on May 10, 2019, and the contents disclosed in any of these applications are incorporated herein by reference in its entirety.

TECHNICAL FIELD

The present invention relates to the field of display technologies, and in particular, to a gamma adjustment method and apparatus for a display panel.

BACKGROUND

In a display device which is clearly visible in a normal environment, visibility of a displayed image is deteriorated upon exposure to a strong light environment such as sunlight. Therefore, there is a need to improve the visibility of display devices in strong light.

SUMMARY

According to an embodiment of the present invention, there is provided a gamma adjustment method of a display panel, including:

obtaining a light intensity of ambient light of the display panel;

obtaining a value of an intensity of the reflected light from the display panel according to the light intensity of the ambient light and a corresponding relation between the intensity of the reflected light from the display panel and the light intensity of the ambient light; and determining a gamma curve of the display panel according to the value of the intensity of the reflected light and a maximum brightness of the display panel.

In one embodiment, said determining a gamma curve of the display panel according to the value of the intensity of the reflected light and a maximum brightness of the display panel:

determining a gamma value of the display panel according to the light intensity of the ambient light;

determining a value of a curve parameter of the gamma curve of the display panel according to the value of the intensity of the reflected light; and determining the gamma curve according to the gamma value and the value of the curve parameter.

In one embodiment, said determining a value of a curve parameter of the gamma curve of the display panel according to the value of the intensity of the reflected light comprises:

substituting the value of the intensity of the reflected light into a relational expression of the gamma curve as a target brightness of a 0 grayscale image of the display panel, and calculating the value of the curve parameter;

wherein the relation expression of the gamma curve is as follows:

$$L_n = L_{max}\left(\frac{n+n_0}{n_{max}+n_0}\right)^{\gamma}$$

wherein $L_n$ is a target brightness of a $n^{th}$ grayscale image of the display panel, $L_{max}$ is the maximum brightness of the display panel, n is a number of the grayscale and $n_0$ is the curve parameter of the gamma curve, $n_{max}$ is the maximum grayscale, and γ is the gamma value.

In one embodiment, the corresponding relationship between the intensity of the reflected light from the display panel and the intensity of the ambient light is:

$$L_{reflect}=L_{ambient}\times f$$

wherein, $L_{reflect}$ is the intensity of the reflected light from the display panel, $L_{ambient}$ is the light intensity of the ambient light, and f is a reflectance of the display panel to the incident light.

In one embodiment, the $L_{ambient}$ can be the intensity of ambient light incident normally to the display panel.

In one embodiment, one side of the display panel is provided with an ambient light sensor, and the display panel is provided with a through hole therein, and the through hole extends in a direction perpendicular to a display surface of the display panel; the ambient light sensor is opposite to the through hole, so that the ambient light sensor is capable of detecting the light intensity of the ambient light on the other side of the display panel.

In one embodiment, said determining a gamma value of the display panel according to the light intensity of the ambient light comprises:

determining a value of a pupil diameter of a human eye according to the light intensity of the ambient light and the corresponding relation between the light intensity and the pupil diameter of the human eye; and determining the gamma value of the display panel according to the value of the pupil diameter of the human eye and the corresponding relation between the pupil diameter of the human eye and the gamma value.

In one embodiment, said determining a gamma value of the display panel according to the light intensity of the ambient light comprises:

determining the gamma value of the display panel according to the light intensity of the ambient light and the corresponding relation between the light intensity and the gamma value.

In one embodiment, after said determining a gamma curve of the display panel according to the value of the intensity of the reflected light and a maximum brightness of the display panel, the method further comprises:

determining a target brightness of each grayscale according to the gamma curve; and determining a value of a grayscale voltage of each grayscale according to the target brightness of each grayscale and the corresponding relation between the brightness and the grayscale voltage.

In one embodiment, after said determining a gamma curve of the display panel according to the value of the intensity of the reflected light and a maximum brightness of the display panel, the method further comprises:

receiving adjustment information for adjusting a target brightness of a 0 grayscale image;

updating a value of the target brightness of the 0 grayscale image according to the adjusting information; and updating the gamma curve of the display panel according to the updated value of the target brightness of the 0 grayscale image and the maximum brightness of the display panel. The adjustment information is inputted by a key input, a touch screen input, a voice input, a gesture input, or an eye motion input.

According to an embodiment of the present invention, there is provided a gamma adjustment apparatus for a display panel including:

a first acquisition module for obtaining a light intensity of ambient light of the display panel;

a second acquisition module for obtaining a value of an intensity of the reflected light from the display panel according to the light intensity of the ambient light and a corresponding relation between the intensity of the reflected light from the display panel and the light intensity of the ambient light; and a determining module for determining a gamma curve of the display panel according to the value of the intensity of the reflected light and a maximum brightness of the display panel.

According to an embodiment of the present invention, there is provided a terminal device, comprising a processor and a memory for storing a computer program; the processor is configured to execute the computer program stored on the memory, to carry out the above method steps.

According to an embodiment of the invention, there is provided a computer-readable storage medium, on which a computer program is stored which, when being executed by a processor, carries out the above-mentioned method steps.

It is to be understood that both the foregoing general description and the following detailed description are exemplary and explanatory only and are not limitation of the invention.

BRIEF DESCRIPTION OF THE DRAWINGS

The accompanying drawings, which are incorporated in and constitute a part of this specification, illustrate embodiments consistent with the present invention and serve to explain the principles of the present invention together with the description.

DETAILED DESCRIPTION

Reference will now be made in detail to the exemplary embodiments, examples of which are illustrated in the accompanying drawings. The following description refers to the accompanying drawings in which the same numbers in different drawings represent the same or similar elements unless otherwise indicated. The implementations described in the following exemplary embodiments do not represent all implementations consistent with the present invention. Rather, they are merely examples of apparatus and methods consistent with certain aspects of the present invention, as detailed in the appended claims.

Figure 1:
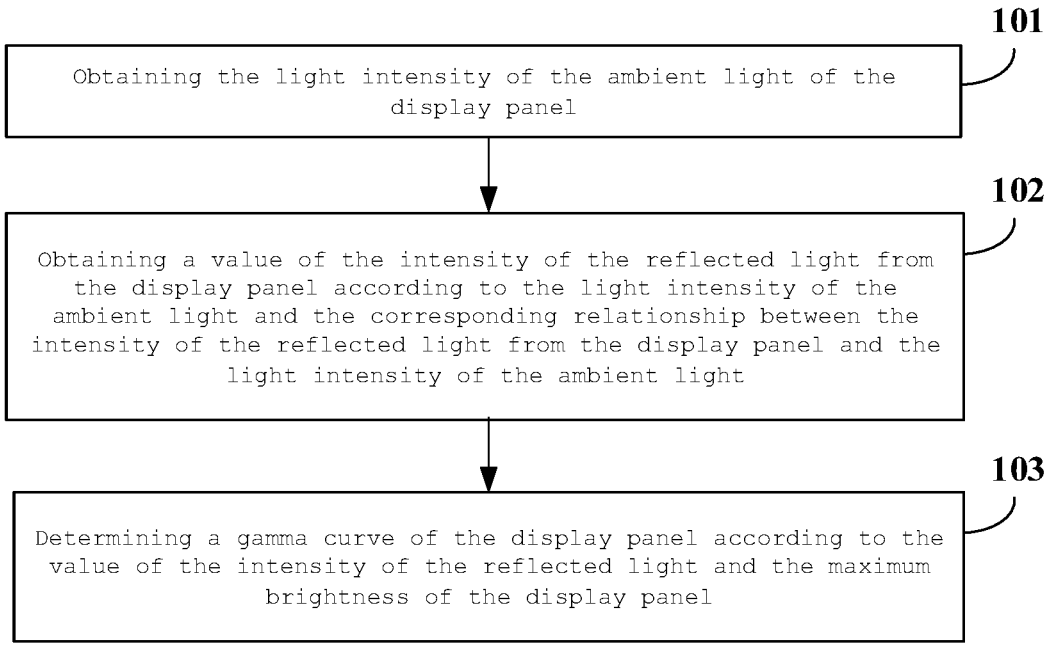
FIG. 1 is a flow chart illustrating a gamma adjustment method according to an embodiment of the present invention.

FIG. 1 illustrates a gamma adjustment method for a display panel according to an embodiment of the present invention. The gamma adjustment method can be applied to a terminal device having a display panel. The terminal device can be a smart phone, a tablet computer, a television and the like. The gamma adjustment method, as shown in FIG. 1, can include the following steps 101 to 103.

In step 101, the light intensity of the ambient light of the display panel is obtained.

Figure 8:
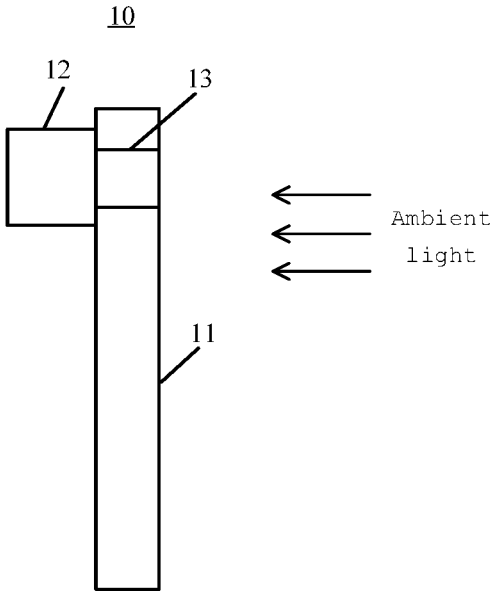
FIG. 8 is a cross-sectional view of a terminal device according to an embodiment of the present invention.

As shown in FIG. 8, in one embodiment of the present disclosure, the terminal device 10 can detect the light intensity of the ambient light on one side of the display panel 11 through the ambient light sensor 12 located on the other side of the display panel 11. The display panel is provided with a through hole 13, and the ambient light sensor 12 is opposite to the through hole 13. For example, in general, the light intensity of the ambient light in a cinema is in the range of 1 to 30 nit, the light intensity of the ambient light in a living room is in the range of 30 to 100 nit, the light intensity of the ambient light in an exhibition hall is in the range of 100 to 200 nit, the light intensity of the ambient light outdoor is in the range of 200 to 400 nit, and the light intensity of the ambient light in a strong light is in the range of 400 nit or more.

In another embodiment, if the display panel currently undergoing gamma adjustment is the first display panel in the same batch of display panels undergoing gamma adjustment, the intensity of the ambient light can be detected by a light sensor located below the display panel. When the light intensity of the ambient light of the display panel is detected, the value of the light intensity of the ambient light of the display panel can be stored for display panel which undergoes subsequent gamma adjustment. If the display panel currently performing gamma adjustment is not the first display panel in the batch of display panels undergoing gamma adjustment in the same batch, the value of the light intensity of the ambient light of the display panel stored in advance can be read, so that the time can be saved, and the efficiency of gamma adjustment can be improved.

In addition, it will be appreciated by those skilled in the art that the ambient light sensor can be disposed at other locations on the display panel, for example, at another side of the display panel. Furthermore, the ambient light sensor can also be arranged separately from the display panel and can be used to measure the ambient light intensity of the display panel only when gamma adjustment of the display panel is performed.

In step 102, a value of the intensity of the reflected light from the display panel is obtained according to the light intensity of the ambient light and the corresponding relationship between the intensity of the reflected light from the display panel and the light intensity of the ambient light.

In one embodiment, the corresponding relationship between the intensity of the reflected light from the display panel and the light intensity of the ambient light can be stored in the terminal device in advance. The corresponding relationship between the intensity of the reflected light from the display panel and the light intensity of the ambient light can be a comparison table of the intensity of the reflected light from the display panel and the ambient light, or can be a functional relationship. The corresponding relationship between the intensity of the reflected light from the display panel and the light intensity of the ambient light can be obtained through testing.

In one embodiment, the corresponding relationship between the intensity of the reflected light from the display panel and the light intensity of the ambient light can be a functional relationship as shown in the following equation (1):

$$L_{reflect}=L_{ambient}\times f \quad (1)$$

wherein, $L_{reflect}$ is the intensity of the reflected light from the display panel, $L_{ambient}$ is the light intensity of the ambient light, and f is the reflectance of the display panel to the incident light.

In one embodiment, the $L_{ambient}$ is the intensity of ambient light incident normal to the display panel. In this embodiment, the extending direction of the through hole on the display panel is perpendicular to the display surface of the display panel. Since the human eye is generally substantially perpendicular to the display surface of the display panel, the accuracy of the calculated minimum brightness can be improved by considering only the perpendicular component of the incident light, and the display effect can be further improved.

In this step, the terminal device can calculate a value of the intensity of the reflected light from the display panel according to the detected light intensity of the ambient light and the corresponding relationship between the intensity of the reflected light from the display panel and the light intensity of the ambient light. For example, when the reflectance f is 1% and the detected intensity of the ambient light of the display panel is 2000 nit, the intensity of the reflected light from the display panel is 20 nit, which can be calculated according to the functional relationship shown in the above equation (1).

In step 103, a gamma curve of the display panel is determined according to the value of the intensity of the reflected light and the maximum brightness of the display panel.

In one embodiment, the terminal device can determine the target brightness of the 0 grayscale image of the display panel according to the value of the intensity of the reflected light from the display panel. For example, the terminal device can determine a value of the intensity of the reflected light from the display panel as a target brightness of the 0 grayscale image of the display panel. For example, the terminal device can determine the target brightness of the 0 grayscale image of the display panel as 20 nit when the intensity of the reflected light $L_{reflect}$ is 20 nit. Certainly, the terminal device can also perform fine adjustment on the value of the intensity of the reflected light from the display panel to obtain the target brightness of the 0 grayscale image of the display panel. In addition, when the intensity of the reflected light $L_{reflect}$ is smaller than the minimum brightness that can be achieved by the display panel, the terminal device can determine the value of the minimum brightness of the display panel as the target brightness of the 0 grayscale image of the display panel.

In one embodiment, the maximum brightness of the display panel can be the maximum brightness that can be displayed by the display panel through testing. For example, the maximum brightness of the display panel can be 300 nit. In this step, the terminal device can determine the target brightness of the maximum grayscale image of the display panel according to the value of the maximum brightness of the display panel. For example, the terminal device can directly use the value of the maximum brightness of the display panel as the target brightness of the maximum grayscale image of the display panel.

In one embodiment, the terminal device can redetermine the gamma curve according to the target brightness of the 0 grayscale image of the display panel and the target brightness of the maximum grayscale image of the display panel. That is, the terminal device can redetermine the gamma curve according to the value of the intensity of the reflected light from the display panel and the maximum brightness of the display panel.

In this embodiment, the value of the intensity of the reflected light from the display panel is obtained by obtaining the light intensity of the ambient light of the display panel and according to the light intensity of the ambient light and the corresponding relationship between the intensity of the reflected light from the display panel and the light intensity of the ambient light. Then, the gamma curve of the display panel is determined according to the value of the intensity of the reflected light and the maximum brightness of the display panel. Therefore, the brightness differences between the grayscale intervals can be ensured while the brightness of the low grayscale intervals is improved, so that the image quality can be ensured even under the environment with higher brightness, and the display effect of the display panel under strong light is improved.

Figure 2:
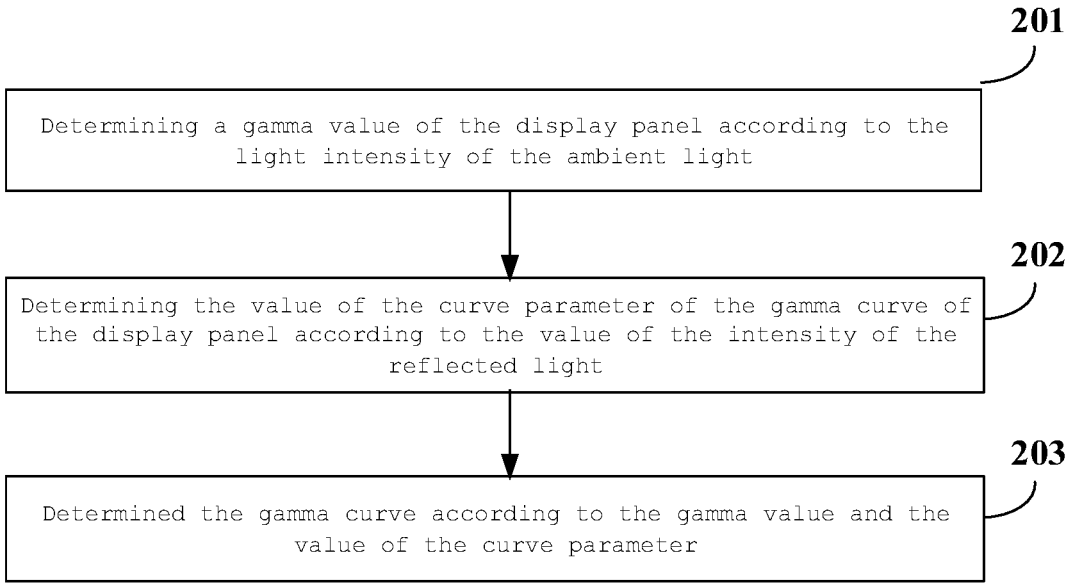
FIG. 2 is a flow chart illustrating another gamma adjustment method according to an embodiment of the present invention.

The embodiment of the invention also provides a gamma adjustment method of the display panel. In this embodiment, on the basis of the embodiment shown in FIG. 1, as shown in FIG. 2, step 103 can include the following steps 201 to 203.

In step 201, a gamma value of the display panel is determined according to the light intensity of the ambient light.

In this embodiment, the relationship of the gamma curve can be expressed as the following equation (2):

$$L_n = L_{max}\left(\frac{n+n_0}{n_{max}+n_0}\right)^{\gamma} \quad (2)$$

wherein, $L_n$ is the target brightness of the $n^{th}$ grayscale image of the display panel and $L_{max}$ is the preset maximum brightness of the display panel, n is the grayscale number and $n_0$ is the curve parameter of the gamma curve and $n_{max}$ is the maximum grayscale, and γ is the gamma value. The value of $n_{max}$ is predetermined according to the actual needs of the display panel and can be, for example, 63, 255 or 1023. The method for determining the curve parameters $n_0$ and gamma value γ for the gamma curve is specifically described below.

In step 202, the value of the curve parameter $n_0$ of the gamma curve of the display panel is determined according to the value of the intensity of the reflected light.

In this step, the value of the intensity of the reflected light can be used as the target brightness of the 0 grayscale image of the display panel, and substituted into the relational expression of the gamma curve to calculate the value of the curve parameter. For example, the value of the intensity of the reflected light can be substituted into the above-described relational expression (2) of the gamma curve as the values of the target brightness $L_{min}$ and the gamma value γ of the 0 grayscale image of the display panel, and since n=0, the following relational expression (3) can be obtained $$L_{reflect} = L_{min} = L_{max}\left(\frac{n_0}{n_{max} + n_0}\right)^{\gamma} \quad (3)$$

By solving the above equation (3), the values of the curve parameters $n_0$ can be obtained.

In step 203, the gamma curve is determined according to the gamma value and the value of the curve parameter.

In this step, the gamma value and the value of the curve parameter can be substituted into the above equation (2) to obtain the adjusted gamma curve.

Figure 3:
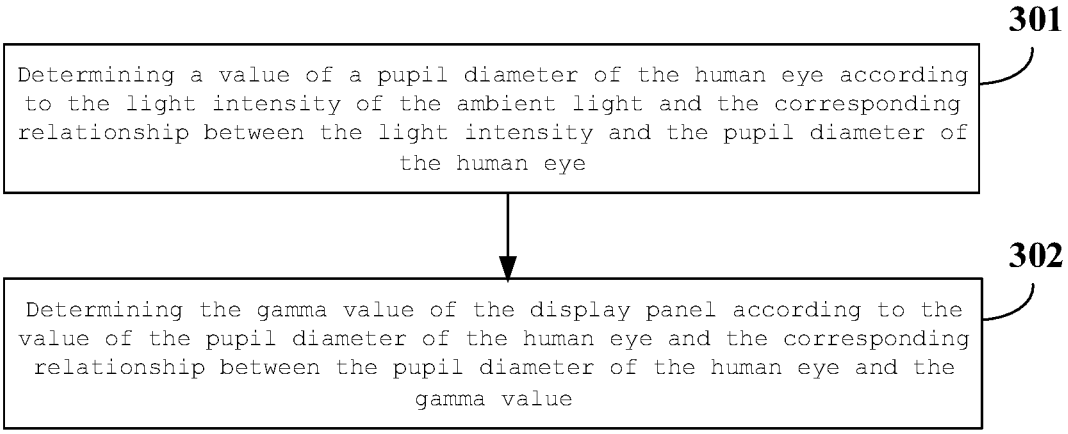
FIG. 3 is a flow chart illustrating another gamma adjustment method according to an embodiment of the present invention.

In this embodiment, as shown in FIG. 3, step 201 can include the following steps 301 to 302.

In step 301, a value of a pupil diameter of the human eye is determined according to the light intensity of the ambient light and the corresponding relationship between the light intensity and the pupil diameter of the human eye.

In step 302, the gamma value of the display panel is determined according to the value of the pupil diameter of the human eye and the corresponding relationship between the pupil diameter of the human eye and the gamma value.

In this embodiment, the corresponding relationship between the light intensity and the pupil diameter of the human eye can be stored in the terminal device in advance. The corresponding relationship between the light intensity and the pupil diameter of the human eye can be a comparison table of the light intensity and the pupil diameter of the human eye, or can be a functional relationship. The corresponding relation between the light intensity and the diameter of the pupil of the human eye can be obtained through testing. The terminal device can determine the value of the pupil diameter of the human eye according to the light intensity of the ambient light and the corresponding relationship between the light intensity and the pupil diameter of the human eye. For example, when the intensity of the ambient light is 2000 nit, the value of the pupil diameter of the human eye can be 8 millimeters.

In this embodiment, the corresponding relationship between the pupil diameter of the human eye and the gamma value can be stored in the terminal device in advance. The corresponding relation between the pupil diameter of the human eye and the gamma value can be a comparison table of the pupil diameter of the human eye and the gamma value, and can also be a functional relation. The corresponding relationship between the pupil diameter of the human eye and the gamma value can be obtained based on experience. For example, in a dark environment, for example, in an environment with a brightness of 30 nit or less (e.g., a movie theater), the pupil diameter of the human eye is large, and thus the gamma value $\gamma$ is large, which can be 2.4 based on experience. In bright environments, for example, in an environment with a brightness of 200-400 nit (e.g., outdoor), the pupil diameter of the human eye is small, and thus the gamma value $\gamma$ is small, which can be 1.8 based on experience. Further, when the pupil diameter of the human eye is between the above two values, the gamma value $\gamma$ can take a value between 2.4 and 1.8. Further, when the pupil diameter of the human eye is smaller, the gamma value $\gamma$ can take a value smaller than 1.8.

In this embodiment, the terminal device can determine the gamma value of the display panel according to the value of the pupil diameter of the human eye and the corresponding relationship between the pupil diameter of the human eye and the gamma value. For example, when the value of the pupil diameter of the human eye is 8 millimeters, the gamma value can be 1.7.

In this embodiment, the value of the pupil diameter of the human eye is determined according to the light intensity of the ambient light and the corresponding relationship between the light intensity and the pupil diameter of the human eye, and then the gamma value of the display panel is determined according to the value of the pupil diameter of the human eye and the corresponding relationship between the pupil diameter of the human eye and the gamma value. Therefore, the gamma value of the display panel can be more accurate, and the gamma curve can better fit the characteristics of human eyes.

Figure 4:
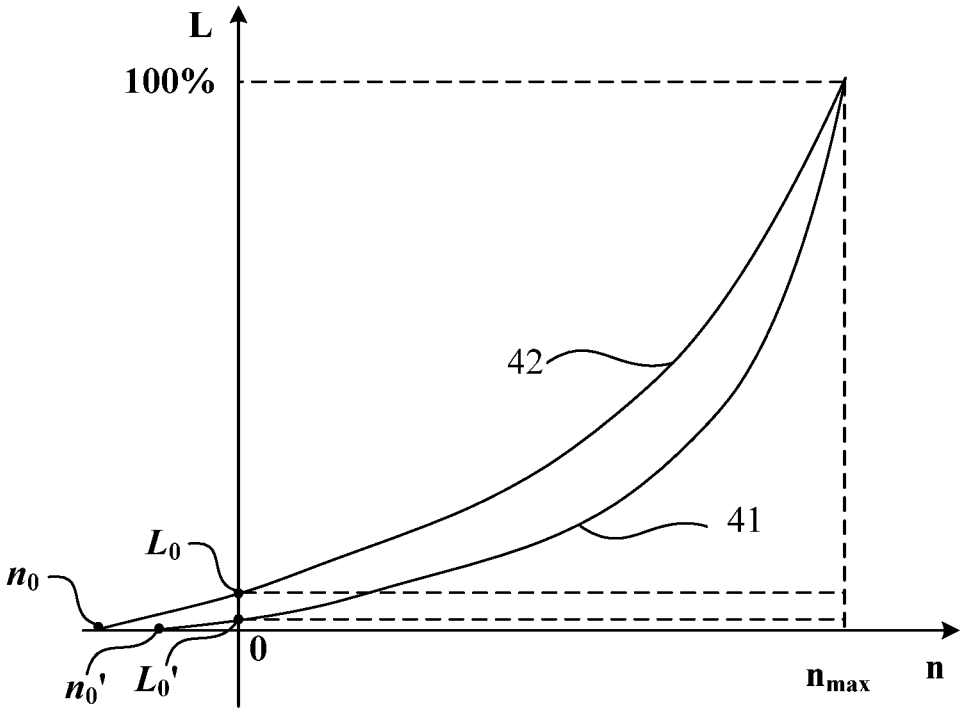
FIG. 4 is a schematic diagram illustrating a gamma curve according to an embodiment of the present invention.

As shown in FIG. 4, when the terminal device is in a living room or office environment, the gamma curve of the terminal device can be a gamma curve 41 shown in FIG. 4, and when the terminal device is in a strong light environment, the gamma curve of the terminal device can be a gamma curve 42 shown in FIG. 4. In FIG. 4, the horizontal axis represents the number of grayscale, and the vertical axis represents the relative value of the target brightness of the display with respect to the maximum brightness of the display panel. As shown in FIG. 4, the target brightness $L_0$ of the 0 grayscale image of the display panel corresponding to the gamma curve 42 is greater than the target brightness $L_0'$ of the 0 grayscale image of the r For example, when the maximum brightness of the display panel is 300 nit, the relative value of the target brightness $L_0$20 nit of the 0 grayscale image of the display panel to the maximum brightness of the display panel is 20/300. The curve parameters of different gamma curves are different, for example, the values of the curve parameters of the gamma curve 41 are different from the values of the curve parameters of the gamma curve 42. In addition, when the ambient brightness is different, the pupil diameter of the human eye has different values, and the gamma value of the gamma curve under different ambient brightness can be different according to the corresponding relationship between the pupil diameter of the human eye and the gamma value.

Therefore, under the condition in which the ambient light intensity is large, the brightness difference between the grayscale intervals can be ensured while the brightness of the low grayscale intervals is improved, so that the quality of the image can be ensured even under the environment with higher brightness, and the display effect of the display panel under strong light is improved.

The embodiment of the invention also provides a gamma adjustment method of the display panel. In this embodiment, on the basis of the embodiments shown in FIG. 1 and FIG. 2, it can be understood by those skilled in the art that in another embodiment of the present disclosure, the gamma value can be determined in step 201 by:

determining the gamma value of the display panel according to the light intensity of the ambient light and the corresponding relation between the light intensity and the gamma value.

In the present embodiment, the terminal device can store the corresponding relationship between the light intensity and the gamma value in advance. The corresponding relationship between the light intensity and the gamma value can be a comparison table of the light intensity and the gamma value or a functional relationship. The corresponding relation between the light intensity and the gamma value can be obtained through testing or other methods. A detailed description thereof will not be given herein.

In this embodiment, the terminal device can determine the gamma value of the display panel according to the light intensity of the ambient light and the corresponding relationship between the light intensity and the gamma value, and the calculation burden is small, so that the gamma adjustment efficiency can be improved.

Figure 5:
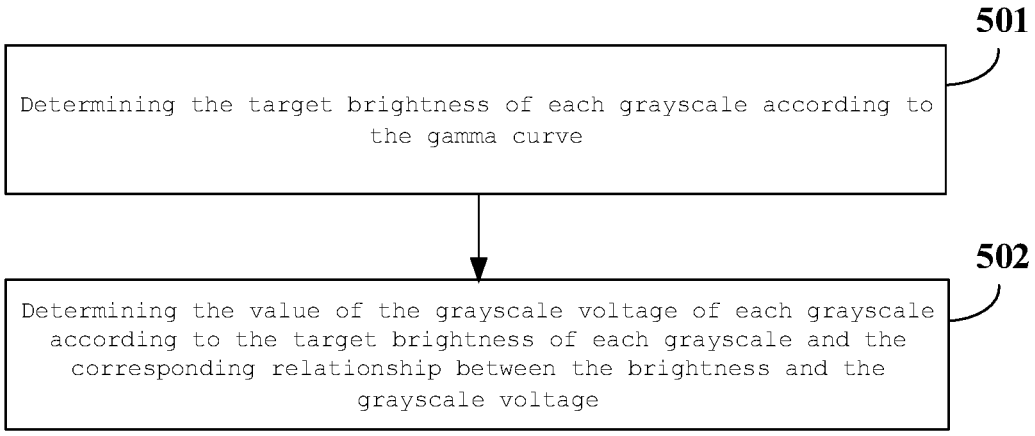
FIG. 5 is a flow chart illustrating another gamma adjustment method according to an embodiment of the present invention.

The embodiment of the invention also provides a gamma adjustment method of the display panel. In this embodiment, on the basis of the embodiment shown in FIG. 1, as shown in FIG. 5, after step 103, the following steps 501 to 502 can further be included.

In step 501, the target brightness of each grayscale is determined according to the gamma curve.

In step 502, the value of the grayscale voltage of each grayscale is determined according to the target brightness of each grayscale and the corresponding relationship between the brightness and the grayscale voltage.

In this embodiment, the terminal device can determine the target brightness of each grayscale according to the gamma curve. Specifically, the target brightness of each grayscale (1 to the maximum grayscale) can be calculated by substituting the grayscale number n of each grayscale into the above equation (2).

In this embodiment, the corresponding relationship between the brightness and the grayscale voltage can be stored in the terminal device in advance. The corresponding relationship between the brightness and the grayscale voltage can be a comparison table of the relative brightness and the grayscale voltage, or a functional relationship of the relative brightness and the grayscale voltage. The corresponding relationship between the brightness and the grayscale voltage can be obtained by testing. The relative brightness is a relative value of the actual brightness of the display panel with respect to the maximum brightness of the display panel. When the terminal device determines the value of the grayscale voltage of each grayscale according to the target brightness of each grayscale and the corresponding relationship between the brightness and the grayscale voltage, the value of the grayscale voltage of each grayscale can be determined according to the relative value of the target brightness of each grayscale with respect to the maximum brightness of the display panel and the corresponding relationship between the brightness and the grayscale voltage.

When the corresponding relation between the brightness and the grayscale voltage is a comparison table of the relative brightness and the grayscale voltage, if the brightness required by a certain grayscale is between two brightness in the table, the value of the grayscale voltage corresponding to the brightness can be obtained by an interpolation method.

It should be noted that, when the comparison table of the brightness and the grayscale voltage is obtained through testing, the voltage signal can be directly applied to the pixel to make the pixel emit light in a state where the display panel is not mounted in the terminal device, without the conversion by the system board of the terminal device. That is, the corresponding relationship between the brightness and the grayscale voltage is obtained by directly applying different voltage signals to the pixels through testing. For example, when the display panel is a liquid crystal display panel, different voltage signals can be applied to the pixels under a fixed reference voltage signal, and the corresponding relationship between the brightness and the grayscale voltage can be tested. Of course, the display panel can also be other types of display panels, and is not limited to the liquid crystal display panel in the embodiment of the present invention.

In this embodiment, the terminal device can determine the value of the grayscale voltage of each grayscale according to the target brightness of each grayscale and the corresponding relationship between the brightness and the grayscale voltage. Moreover, the terminal device can store the corresponding relation between the grayscale and the grayscale voltage. The terminal device can determine the grayscale value corresponding to each pixel according to the image data, determine the grayscale voltage value of each pixel according to the grayscale value and the corresponding relation between the grayscale and the grayscale voltage, and then transmit the corresponding grayscale voltage to the pixel according to the grayscale voltage value of the pixel to enable the pixel to display the specified brightness.

In this embodiment, the terminal device can determine the target brightness of each grayscale according to the adjusted gamma curve, and determine the value of the grayscale voltage of each grayscale according to the target brightness of each grayscale and the corresponding relationship between the brightness and the grayscale voltage. Furthermore, the brightness difference between the grayscale intervals can be ensured, the quality of image is improved, and the display effect of the display panel under strong light is improved.

The embodiment of the invention also provides a gamma adjustment method of the display panel. In this embodiment, on the basis of the gamma adjustment method shown in FIG. 1, after step 101, the following steps can be further included: the terminal device detects whether the light intensity range to which the light intensity of the currently detected ambient light belongs changes, and performs step 102 and subsequent steps when the light intensity range to which the light intensity of the currently detected ambient light belongs changes. For example, it is assumed that the gamma curve currently adopted by the terminal device is determined according to the light intensity range of the ambient light from 1 nit to 30 nit. In this case, if it is detected that the light intensity of the currently detected ambient light is, for example, 300 nit, the range to which the light intensity belongs is determined according to the light intensity of the currently detected ambient light, for example, 200 to 400 nit. Then, it is determined whether the light intensity range 200 to 400 nit to which the light intensity of the currently detected ambient light belongs is consistent with the light intensity range 1 to 30 nit. When there are not consistent with each other, it is determined that the light intensity range to which the light intensity of the currently detected ambient light belongs is changed and then step 102 and the subsequent steps are performed. Of course, when the terminal device determines that the light intensity range to which the light intensity of the currently detected ambient light belongs has not changed, step 102 and the subsequent steps are not performed. Thus, the waste of power consumption caused by frequent adjustment of the gamma curve can be avoided.

The embodiment of the invention also provides a gamma adjustment method of the display panel. In this embodiment, the reflectance of the display panel is 1%, the maximum grayscale is 255, the maximum brightness is 300 nit, and the minimum brightness is 0.3 nit. The intensity of the reflected light has a value of 20 nit under 2000 nit of sunlight. At this time, the diameter of the pupil of the human eye reaches 8 mm, and the gamma value γ of the corresponding gamma (Gamma) curve is 1.7, so that the gamma curve has the following equation (4):

$$L_n = 300 \times \left(\frac{n + n_0}{255 + n_0}\right)^{1.7} \tag{4}$$

The value 20 nit of the intensity of the reflected light is used as the target brightness of the 0 grayscale image of the adjusted display panel, and is substituted into the relational expression (4) of the gamma curve to obtain an expression (5), and the value of the curve parameter no is obtained by solving the expression (5).

$$20 = 300 \times \left(\frac{n_0}{255 + n_0}\right)^{1.7} \quad (5)$$

The adjusted gamma curve can be obtained by substituting the value of the curve parameter no into the equation (4). According to the adjusted gamma curve, the target brightness of each grayscale can be determined, and the value of the grayscale voltage of each grayscale is determined according to the target brightness of each grayscale and the corresponding relation between the brightness and the grayscale voltage. Therefore, the brightness difference between the grayscale intervals can be ensured while the brightness of the low grayscale interval is improved, so that the definition of the display image in human eyes can be ensured even under the environment with higher brightness, and the backlight brightness does not need to be improved.

For this display panel, it can be determined that when the display panel is in a cinema environment, the target brightness of the 0 grayscale image of the display panel is the lowest brightness of the display panel, i.e., 0.3 nit. Therefore, when the display panel is moved from the living room environment to the sunlit environment, the target brightness of the 0 grayscale image of the display panel needs to be increased from 0.3 nit to 20 nit, and the brightness needs to be increased by 66 times. In this case, if the target brightness of the maximum grayscale image of the display panel is increased proportionally to keep the image clear, the target brightness of the maximum grayscale image also needs to be increased by 66 times from 300 nit, and thus reaches 20000 nit. If the transmittance of the liquid crystal is 5%, the backlight brightness must reach 400000 nit to meet the requirement, which is impossible with the current display panel. However, according to the embodiments of the present disclosure, the brightness difference between the respective grayscale intervals can be ensured while the brightness of the low grayscale interval is improved, and the definition of the display image in human eyes can be ensured without improving the target brightness of the maximum grayscale image of the display panel.

The embodiment of the invention also provides a gamma adjustment method of the display panel. In this embodiment, the reflectance of the display panel is 1%, the maximum grayscale is 255, and the maximum brightness of the display panel is 300 nit. Also, in the present embodiment, the maximum value of the light intensity range of the ambient light of the display panel can be obtained through testing. For example, the maximum value of the light intensity range of the ambient light of the display panel is 2000 nit. Then, a value of 20 nit of the intensity of the reflected light from the display panel is obtained based on the maximum value 2000 nit of the light intensity range of the ambient light and the corresponding relationship between the intensity of the reflected light from the display panel and the light intensity of the ambient light. At this time, the diameter of the pupil of the human eye reaches 8 mm, and the gamma value γ of the corresponding gamma (Gamma) curve is 1.7, so that the gamma curve is the following equation (4):

$$L_n = 300 \times \left(\frac{n + n_0}{255 + n_0}\right)^{1.7} \quad (4)$$

The value 20 nit of the intensity of the reflected light is substituted into the relational expression (4) of the gamma curve as the target brightness of the 0 grayscale image of the display panel to obtain expression (5), and the value of the curve parameter no is obtained by solving expression (5).

$$20 = 300 \times \left(\frac{n_0}{255 + n_0}\right)^{1.7} \quad (5)$$

The target gamma curve can be obtained by substituting the value of the curve parameter no into equation (4). Then, the target brightness of each grayscale is determined according to the target gamma curve, and the value of the grayscale voltage of each grayscale is determined according to the target brightness of each grayscale and the corresponding relation between the brightness and the grayscale voltage. Then, the corresponding relation between the grayscale and the grayscale voltage is stored in a driving chip of the display panel, so that the definition of a display image in human eyes can be ensured even if the ambient light of the terminal device is at the maximum value of the light intensity range. Meanwhile, the gamma curve can be prevented from being adjusted by detecting the light intensity of the ambient light of the display panel by using the ambient light sensor, and the consumed power is saved.

Figure 6:
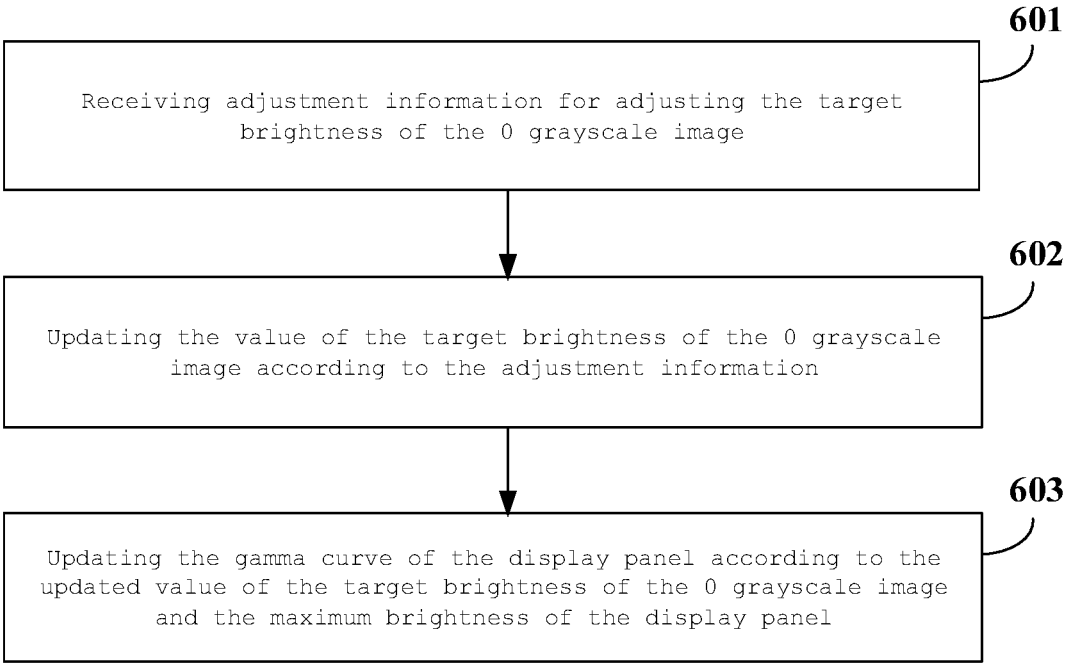
FIG. 6 is a flowchart illustrating another gamma adjustment method according to an embodiment of the present invention.

The embodiment of the invention also provides a gamma adjustment method of the display panel. In this embodiment, on the basis of the embodiment shown in FIG. 1, as shown in FIG. 6, after step 103, the following steps 601 to 603 can further be included:

in step 601, adjustment information for adjusting the target brightness of the 0 grayscale image is received.

In one embodiment, the adjustment information is input by keys. For example, the user can adjust the target brightness of the 0 grayscale image through a designated key on the terminal device. For example, the terminal device can be provided with an adjusting button for adjusting the target brightness of the 0 grayscale image, and the adjusting button includes an increase sub-button and a decrease sub-button. When the increase sub-button is pressed, the terminal device receives first adjustment information for increasing the current target brightness of the 0 grayscale image. Then, the terminal device increases the current target brightness of the 0 grayscale image according to the received first adjustment information, wherein the increment of the target brightness of the 0 grayscale image can be a preset fixed value. When the decrease sub-button is pressed, the terminal device receives second adjustment information for decreasing the current target brightness of the 0 grayscale image. Then, the terminal device reduces the current target brightness of the 0 grayscale image according to the second adjustment information, wherein the reduction amount of the target brightness of the 0 grayscale image can also be the fixed value.

In another embodiment, the adjustment information is input by a touch screen. For example, the user can adjust the target brightness of the 0 grayscale image through a virtual button provided by the terminal device. In the embodiment of the present invention, the implementation of the touch screen input is similar to that of the key input, and is not described herein again.

In yet another embodiment, the adjustment information is input by voice. For example, the user can adjust the target brightness of the 0 grayscale image by inputting a specified voice instruction to the terminal device. In this embodiment, when the user says "brighten the image" to the terminal device, the terminal device receives the first adjustment information for increasing the current target brightness of the 0 grayscale image. Then, the terminal device increases the current target brightness of the 0 grayscale image according to the received first adjustment information, wherein the increment of the target brightness of the 0 grayscale image can be a preset fixed value. When the user says "dimming the image" to the terminal device, the terminal device receives second adjusting information for reducing the current target brightness of the 0 grayscale image. Then, the terminal device reduces the current target brightness of the 0 grayscale image according to the second adjustment information, wherein the reduction amount of the target brightness of the 0 grayscale image can also be the fixed value.

In yet another embodiment, the adjustment information is input by eye movement. In this embodiment, when the user closes the left eye with respect to the terminal device, the terminal device receives first adjustment information for increasing the current target brightness of the 0 grayscale image. Then, the terminal device increases the current target brightness of the 0 grayscale image according to the received first adjustment information, wherein the increment of the target brightness of the 0 grayscale image can be a preset fixed value. And when the user closes the right eye with respect to the terminal device, the terminal device receives second adjusting information for reducing the current target brightness of the 0 grayscale image. Then, the terminal device reduces the current target brightness of the 0 grayscale image according to the second adjustment information, wherein the reduction amount of the target brightness of the 0 grayscale image can also be the fixed value.

Of course, the input manner of the adjustment information can also be gesture input, but is not limited thereto. In the embodiment of the present invention, the implementation manner of the gesture input is similar to that of the eye movement input, and is not described herein again.

In step 602, the value of the target brightness of the 0 grayscale image is updated according to the adjustment information.

In step 603, the gamma curve of the display panel is updated according to the updated value of the target brightness of the 0 grayscale image and the maximum brightness of the display panel.

In this embodiment, the terminal device can update the value of the target brightness of the 0 grayscale image of the display panel according to the received adjustment information, and update the gamma curve of the display panel according to the updated value of the target brightness of the 0 grayscale image and the maximum brightness of the display panel.

In this embodiment, by receiving the adjustment information for adjusting the target brightness of the 0 grayscale image, updating the value of the target brightness of the 0 grayscale image according to the adjustment information, and updating the gamma curve of the display panel according to the updated value of the target brightness of the 0 grayscale image and the maximum brightness of the display panel, a user can adjust the display mode of the display panel according to personal preference, which is beneficial to improving user experience.

Figure 7:
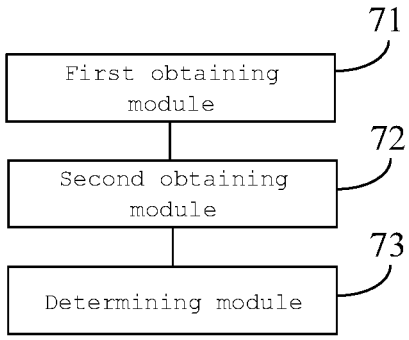
FIG. 7 is a block diagram illustrating a gamma adjustment apparatus according to an embodiment of the present invention.

An embodiment of the present invention further provides a gamma adjustment apparatus, as illustrated in FIG. 7, including:

a first obtaining module 71, configured to obtain a light intensity of ambient light of the display panel;

a second obtaining module 72, configured to obtain a value of the intensity of the reflected light from the display panel according to the light intensity of the ambient light and a corresponding relationship between the intensity of the reflected light from the display panel and the light intensity of the ambient light; and a determining module 73, configured to determine a gamma curve of the display panel according to the value of the intensity of the reflected light and the maximum brightness of the display panel.

The beneficial effect of this embodiment is: the visual brightness difference in the low grayscale interval can be ensured, the image quality can be ensured even in the environment with higher brightness, and the display effect of the display panel under strong light is improved.

In one embodiment, the gamma adjustment apparatus further comprises:

a first calculation module used for determining the target brightness of each grayscale according to the gamma curve;

a second calculation module used for determining a value of the grayscale voltage of each grayscale according to the target brightness of each grayscale and the corresponding relation between the brightness and the grayscale voltage; and a first storage module used for storing the corresponding relation between the brightness and the grayscale voltage so as to be invoked by the second calculation module.

In one embodiment, the gamma adjustment apparatus further comprises:

a third calculation module used for determining the gamma value of the display panel according to the light intensity of the ambient light;

a fourth calculation module used for determining a value of the curve parameter of the gamma curve of the display panel according to the value of the intensity of the reflected light; and a fifth calculation module used for determining the gamma curve according to the gamma value and the value of the curve parameter.

In one embodiment, the third computing module can include:

a first calculation submodule used for determining a value of the pupil diameter of the human eye according to the light intensity of the ambient light and the corresponding relation between the light intensity and the pupil diameter of the human eye;

a second calculation submodule used for determining a gamma value of the display panel according to the value of the pupil diameter of the human eye and the corresponding relation between the pupil diameter of the human eye and the gamma value;

a first storage submodule used for storing the corresponding relation between the light intensity and the diameter of the pupil of the human eye so as to be invoked by the first calculation submodule; and a second storage submodule used for storing the corresponding relation between the pupil diameter of the human eye and the gamma value so as to be invoked by the second calculation submodule.

In one embodiment, the third computing module can include:

a third calculation submodule used for determining the gamma value of the display panel according to the light intensity of the ambient light and the corresponding relation between the light intensity and the gamma value; and a third storage submodule used for storing the corresponding relation between the light intensity and the gamma value so as to be invoked by the third calculation submodule.

The embodiment of the invention also provides a terminal device, which comprises a processor and a memory for storing a computer program; the processor is configured to execute the computer program stored in the memory to implement the method steps of any of the above embodiments.

For the device and apparatus in the above described embodiments, the specific manner in which the processor performs the operations has been described in detail in the embodiments related to the method, and will not be described in detail herein.

Figure 9:
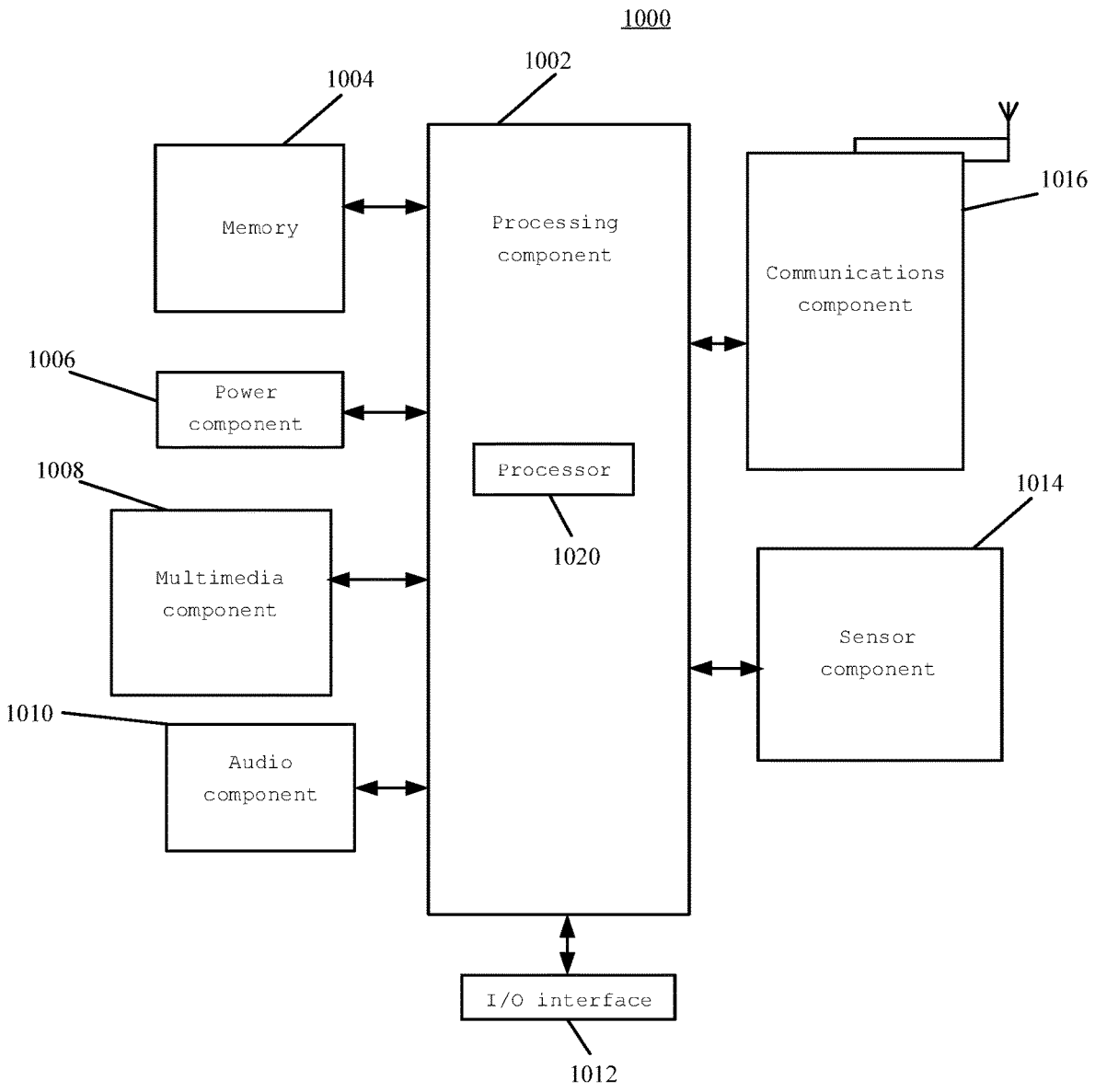
FIG. 9 is a schematic structural diagram of a terminal device according to an embodiment of the present invention.

FIG. 9 is a block diagram illustrating a terminal device according to an example embodiment. For example, the device 1000 can be a television, a mobile phone, a computer, a digital broadcast terminal, a message transceiving device, a gaming console, a tablet device, a medical device, a physical exercise device, a personal digital assistant, and so forth.

Referring to FIG. 9, the device 1000 can include one or more of the following components: processing component 1002, memory 1004, power component 1006, multimedia component 1008, audio component 1010, input/output (I/O) interface 1012, sensor component 1014, and communications component 1016.

The processing component 1002 generally controls overall operation of the device 1000, such as operations associated with display, data communication, and recording operations. The processing component 1002 can include one or more processors 1020 to execute instructions to carry out all or part of the steps of the methods described above. Further, processing component 1002 can include one or more modules that facilitate interaction between processing component 1002 and other components. For example, the processing component 1002 can include a multimedia module to facilitate interaction between the multimedia component 1008 and the processing component 1002.

The memory 1004 is configured to store various types of data to support operation at the device 1000. Examples of such data include instructions for any application or method operating on device 1000, messages, pictures, video, and the like. The memory 1004 can be implemented by any type of volatile or non-volatile storage devices or combination thereof, such as Static Random Access Memory (SRAM), electrically erasable programmable read-only memory (EEPROM), erasable programmable read-only memory (EPROM), programmable read-only memory (PROM), read-only memory (ROM), magnetic memory, flash memory, magnetic or optical disks.

Power component 1006 provides power to the various components of device 1000. Power component 1006 can include a power management system, one or more power supplies, and other components associated with generating, managing, and distributing power for device 1000.

The multimedia component 1008 includes a screen that provides an output interface between the device 1000 and a user. In some embodiments, the screen can include a Liquid Crystal Display (LCD) and a Touch Panel (TP). If the screen includes a touch panel, the screen can be implemented as a touch screen to receive an input signal from a user. The touch panel includes one or more touch sensors to sense touch, slide, and gestures on the touch panel. The touch sensor can not only sense the boundary of a touch or slide action, but also detect the duration and pressure associated with the touch or slide operation.

Audio component 1010 is configured to output and/or input audio signals. For example, audio component 1010 includes a Microphone (MIC) configured to receive external audio signals when device 1000 is in an operational mode, such as a call mode, a record mode, and a voice recognition mode. The received audio signal can further be stored in the memory 1004 or transmitted via the communications component 1016. In some embodiments, audio component 1010 further includes a speaker for outputting audio signals.

I/O interface 1012 provides an interface between the processing component 1002 and peripheral interface modules, which can be buttons or the like. These buttons can include, but are not limited to: a volume button, a start button, and a lock button.

The sensor component 1014 includes one or more sensors for providing status assessment for various aspects of the device 1000. For example, the sensor component 1014 can include a light sensor, such as a CMOS or CCD image sensor, for use in imaging applications.

Communications component 1016 is configured to facilitate communications between device 1000 and other devices in a wired or wireless manner. The device 1000 can access a wireless network based on a communication standard, such as WiFi, 2G or 3G, 4G LTE, 5G NR, or a combination thereof. In an exemplary embodiment, the communications component 1016 further includes a Near Field Communication (NFC) module to facilitate short-range communications. For example, the NFC module can be implemented based on Radio Frequency Identification (RFID) technology, infrared data association (IrDA) technology, Ultra Wideband (UWB) technology, Bluetooth (BT) technology, and other technologies.

In an exemplary embodiment, the device 1000 can be implemented by one or more Application Specific Integrated Circuits (ASICs), Digital Signal Processors (DSPs), Digital Signal Processing Devices (DSPDs), Programmable Logic Devices (PLDs), Field Programmable Gate Arrays (FPGAs), controllers, micro-controllers, microprocessors, or other electronic components for performing the above-described methods.

In an exemplary embodiment, a non-transitory computer-readable storage medium comprising instructions, such as the memory 1004 comprising instructions, executable by the processor 1020 of the device 1000 to carry out the above-described method is also provided. For example, the non-transitory computer readable storage medium can be a ROM, a Random Access Memory (RAM), a CD-ROM, a magnetic tape, a floppy disk, an optical data storage device, and the like.

In the present invention, the terms "first", "second" are used for descriptive purposes only and are not to be construed as indicating or implying relative importance. The term "plurality" means two or more unless explicitly defined otherwise.

Other embodiments of the invention will be apparent to those skilled in the art from consideration of the specification and practice of the disclosure disclosed herein. The invention is intended to cover any variations, uses, or adaptations of the invention following the general principles of the invention and including known or customary technical means within the art to which the invention pertains that has not been disclosed in the present disclosure. It is intended that the specification and examples be considered as exemplary only, and the real scope and spirit of the invention is indicated by the following claims.

It will be understood that the invention is not limited to the precise arrangements that have been described above and shown in the drawings, and that various modifications and changes can be made without departing from the scope thereof. The scope of the invention is limited only by the appended claims.

What is claimed is:

1. A gamma adjustment method for a display panel includes:

obtaining a light intensity of ambient light of the display panel;

obtaining a value of an intensity of reflected light from the display panel according to the light intensity of the ambient light and a corresponding relation between the intensity of the reflected light from the display panel and the light intensity of the ambient light; and determining a gamma curve of the display panel according to the value of the intensity of the reflected light and a maximum brightness of the display panel.

2. The gamma adjustment method according to claim 1, wherein said determining a gamma curve of the display panel according to the value of the intensity of the reflected light and a maximum brightness of the display panel:

determining a gamma value of the display panel according to the light intensity of the ambient light;

determining a value of a curve parameter of the gamma curve of the display panel according to the value of the intensity of the reflected light; and determining the gamma curve according to the gamma value and the value of the curve parameter.

3. The gamma adjustment method according to claim 2, wherein said determining a value of a curve parameter of the gamma curve of the display panel according to the value of the intensity of the reflected light comprises:

substituting the value of the intensity of the reflected light into a relational expression of the gamma curve as a target brightness of a 0 grayscale image of the display panel, and calculating the value of the curve parameter;

wherein the relational expression of the gamma curve is as follows:

$$L_n = L_{max}\left(\frac{n+n_0}{n_{max}+n_0}\right)^{\gamma}$$

wherein $L_n$ is a target brightness of a $n^{th}$ grayscale image of the display panel, $L_{max}$ is the maximum brightness of the display panel, n is a number of the grayscale and $n_0$ is the curve parameter of the gamma curve, $n_{max}$ is a maximum grayscale, and γ is the gamma value.

4. The gamma adjustment method according to claim 1, wherein the corresponding relation between the intensity of the reflected light from the display panel and the intensity of the ambient light is:

$$L_{reflect}=L_{ambient}\times f$$

wherein, $L_{reflect}$ is the intensity of the reflected light from the display panel, $L_{ambient}$ is the light intensity of the ambient light, and f is a reflectance of the display panel to incident light.

5. The gamma adjustment method according to claim 4, wherein the $L_{ambient}$ is the intensity of ambient light incident normally to the display panel.

6. The gamma adjustment method according to claim 4, wherein one side of the display panel is provided with an ambient light sensor, and the display panel is provided with a through hole therein, and the through hole extends in a direction perpendicular to a display surface of the display panel; the ambient light sensor is opposite to the through hole, so that the ambient light sensor is capable of detecting the light intensity of the ambient light on the other side of the display panel.

7. The gamma adjustment method according to claim 2, wherein said determining a gamma value of the display panel according to the light intensity of the ambient light comprises:

determining a value of a pupil diameter of a human eye according to the light intensity of the ambient light and the corresponding relation between the light intensity and the pupil diameter of the human eye; and determining the gamma value of the display panel according to the value of the pupil diameter of the human eye and the corresponding relation between the pupil diameter of the human eye and the gamma value.

8. The gamma adjustment method according to claim 2, wherein said determining a gamma value of the display panel according to the light intensity of the ambient light comprises:

determining the gamma value of the display panel according to the light intensity of the ambient light and the corresponding relation between the light intensity and the gamma value.

9. The gamma adjustment method according to claim 1, wherein after said determining a gamma curve of the display panel according to the value of the intensity of the reflected light and a maximum brightness of the display panel, the method further comprises:

determining a target brightness of each grayscale according to the gamma curve; and determining a value of a grayscale voltage of each grayscale according to the target brightness of each grayscale and the corresponding relation between the target brightness and the grayscale voltage.

10. The gamma adjustment method according to claim 1, wherein after said determining a gamma curve of the display panel according to the value of the intensity of the reflected light and a maximum brightness of the display panel, the method further comprises:

receiving adjustment information for adjusting a target brightness of a 0 grayscale image;

updating a value of the target brightness of the 0 grayscale image according to the adjustment information; and updating the gamma curve of the display panel according to the updated value of the target brightness of the 0 grayscale image and the maximum brightness of the display panel.

11. The gamma adjustment method according to claim 10, wherein the adjustment information is inputted by a key input, a touch screen input, a voice input, a gesture input, or an eye motion input.

12. A terminal device comprising a processor and a memory for storing a computer program; the processor is configured to execute the computer program stored on the memory, to carry out a gamma adjustment method for a display panel, the method includes:

obtaining a light intensity of ambient light of the display panel;

obtaining a value of an intensity of reflected light from the display panel according to the light intensity of the ambient light and a corresponding relation between the intensity of the reflected light from the display panel and the light intensity of the ambient light; and determining a gamma curve of the display panel according to the value of the intensity of the reflected light and a maximum brightness of the display panel.

13. A computer-readable storage medium, on which a computer program is stored which, when being executed by a processor, carries out a gamma adjustment method for a display panel, the method includes:

obtaining a light intensity of ambient light of the display panel;

obtaining a value of an intensity of reflected light from the display panel according to the light intensity of the ambient light and a corresponding relation between the intensity of the reflected light from the display panel and the light intensity of the ambient light; and determining a gamma curve of the display panel according to the value of the intensity of the reflected light and a maximum brightness of the display panel.

14. The terminal device according to claim 12, wherein said determining a gamma curve of the display panel according to the value of the intensity of the reflected light and a maximum brightness of the display panel:

determining a gamma value of the display panel according to the light intensity of the ambient light;

determining a value of a curve parameter of the gamma curve of the display panel according to the value of the intensity of the reflected light; and determining the gamma curve according to the gamma value and the value of the curve parameter.

15. The terminal device according to claim 14, wherein said determining a value of a curve parameter of the gamma curve of the display panel according to the value of the intensity of the reflected light comprises:

substituting the value of the intensity of the reflected light into a relational expression of the gamma curve as a target brightness of a 0 grayscale image of the display panel, and calculating the value of the curve parameter;

wherein the relational expression of the gamma curve is as follows:

$$L_n = L_{max}\left(\frac{n+n_0}{n_{max}+n_0}\right)^{\gamma}$$

wherein $L_n$ is a target brightness of a $n^{th}$ grayscale image of the display panel, $L_{max}$ is the maximum brightness of the display panel, n is a number of the grayscale and $n_0$ is the curve parameter of the gamma curve, $n_{max}$ is a maximum grayscale, and $\gamma$ is the gamma value.

16. The terminal device according to claim 12, wherein the corresponding relation between the intensity of the reflected light from the display panel and the intensity of the ambient light is:

$$L_{reflect}=L_{ambient}\times f$$

wherein, $L_{reflect}$ is the intensity of the reflected light from the display panel, $L_{ambient}$ is the light intensity of the ambient light, and f is a reflectance of the display panel to incident light.

17. The terminal device according to claim 16, wherein the $L_{ambient}$ is the intensity of ambient light incident normally to the display panel.

18. The terminal device according to claim 16, wherein one side of the display panel is provided with an ambient light sensor, and the display panel is provided with a through hole therein, and the through hole extends in a direction perpendicular to a display surface of the display panel; the ambient light sensor is opposite to the through hole, so that the ambient light sensor is capable of detecting the light intensity of the ambient light on the other side of the display panel.

19. The terminal device according to claim 12, wherein said determining a gamma value of the display panel according to the light intensity of the ambient light comprises:

determining a value of a pupil diameter of a human eye according to the light intensity of the ambient light and the corresponding relation between the light intensity and the pupil diameter of the human eye; and determining the gamma value of the display panel according to the value of the pupil diameter of the human eye and the corresponding relation between the pupil diameter of the human eye and the gamma value.

20. The terminal device according to claim 12, wherein said determining a gamma value of the display panel according to the light intensity of the ambient light comprises:

determining the gamma value of the display panel according to the light intensity of the ambient light and the corresponding relation between the light intensity and the gamma value.

21. The terminal device according to claim 12, wherein after said determining a gamma curve of the display panel according to the value of the intensity of the reflected light and a maximum brightness of the display panel, the method further comprises:

determining a target brightness of each grayscale according to the gamma curve; and determining a value of a grayscale voltage of each grayscale according to the target brightness of each grayscale and the corresponding relation between the target brightness and the grayscale voltage.

22. The terminal device according to claim 12, wherein after said determining a gamma curve of the display panel according to the value of the intensity of the reflected light and a maximum brightness of the display panel, the method further comprises:

receiving adjustment information for adjusting a target brightness of a 0 grayscale image;

updating a value of the target brightness of the 0 grayscale image according to the adjustment information; and updating the gamma curve of the display panel according to the updated value of the target brightness of the 0 grayscale image and the maximum brightness of the display panel.

23. The terminal device according to claim 22, wherein the adjustment information is inputted by a key input, a touch screen input, a voice input, a gesture input, or an eye motion input.

* * * * *